US012022937B2

(12) United States Patent
Bradshaw

(10) Patent No.: US 12,022,937 B2
(45) Date of Patent: Jul. 2, 2024

(54) TOOTHBRUSH WITH NOVEL BRISTLE ARRANGEMENT, DETACHABLE BRISTLE HEAD, AND INTEGRATED CALENDAR REMINDER FEATURE

(71) Applicant: Renee Bradshaw, New York, NY (US)

(72) Inventor: Renee Bradshaw, New York, NY (US)

( * ) Notice: Subject to any disclaimer, the term of this patent is extended or adjusted under 35 U.S.C. 154(b) by 293 days.

(21) Appl. No.: 17/665,623

(22) Filed: Feb. 7, 2022

(65) Prior Publication Data

US 2023/0248138 A1 Aug. 10, 2023

(51) Int. Cl.

| | |
|---|---|
| ***A46B 9/04*** | (2006.01) |
| ***A46B 5/00*** | (2006.01) |
| ***A46B 7/04*** | (2006.01) |
| ***A46B 15/00*** | (2006.01) |

(52) U.S. Cl.

CPC ..... *A46B 5/0095* (2013.01); *A46B 7/042* (2013.01); *A46B 9/04* (2013.01); *A46B 15/001* (2013.01); *A46B 15/0085* (2013.01); *A46B 2200/1066* (2013.01)

(58) Field of Classification Search

CPC ..... A46B 9/04; A46B 2200/1066; A46B 7/04; A46B 7/042; A46B 15/0085

See application file for complete search history.

(56) References Cited

U.S. PATENT DOCUMENTS 1,698,128 A * 1/1929 Funk ..... A46B 7/04 15/194
5,072,477 A * 12/1991 Pai ..... A46B 15/00 15/176.1
5,864,915 A * 2/1999 Ra ..... A46B 7/04 15/176.4

FOREIGN PATENT DOCUMENTS

DE 3416874 A1 * 11/1985

* cited by examiner

*Primary Examiner* — Daniel J Colilla

(57) ABSTRACT

The present disclosure provides a new design for a toothbrush having a detachable bristle head portion that interlocks with a bristle frame mounting portion to form a watertight seal. The detachable bristle head has a novel bristle formation, with the bristle holes being formed into parallel horizontal lines, and the bristles taking on a rounded shape. The toothbrush is further provided with a novel calendar reminder mechanism in the form of a rotatable cap coupled to the distal end of the brush handle, allowing a user to set a month reminder for the next time the detachable bristle head should be replaced.

14 Claims, 5 Drawing Sheets

TOOTHBRUSH WITH NOVEL BRISTLE ARRANGEMENT, DETACHABLE BRISTLE HEAD, AND INTEGRATED CALENDAR REMINDER FEATURE

FIELD OF INVENTION

The present invention relates to toothbrushes, and more particularly, to toothbrushes with a detachable bristle head having a particular bristle pattern for more efficacious cleaning, and a calendar reminder function for exchanging bristle heads.

BACKGROUND

The primary purpose of a toothbrush is to clean the teeth by removing plaque and debris from the tooth surfaces, including the curved outer tooth surfaces and the interproximal surfaces between the teeth, i.e. the topography of the teeth.

To facilitate such cleaning, conventional toothbrushes comprise generally uniform length tufts of bristles arranged in vertical rows forming a flat bristle trim, each bristle having a first end which is held captive in and fixed to a bristle head of the brush, and a second, free end, which is used for brushing.

Toothbrushes having such a generally flat bristle trim are limited in their ability to conform to the curvature of the teeth, to penetrate into the interproximal areas between the teeth and to sweep away the plaque and debris as bristles within a flat bristle trim tend to interfere with each other.

Users have to press hard with such bristles to ensure that a deep clean between the teeth is achieved, and this can cause gum bleeding and overbrushing.

Furthermore, conventional manual brushes (non-electric) generally have a bristle head which is integrated with the plastic body and handle, meaning that replacing the bristle head that quickly becomes worn entails replacing the entire brush, causing much unnecessary plastic waste.

It is within this context that the present invention is provided.

SUMMARY

The present disclosure provides a new design for a toothbrush having a detachable bristle head portion that interlocks with a bristle frame mounting portion to form a watertight seal. The detachable bristle head has a novel bristle formation, with the bristle holes being formed into parallel horizontal lines, and the bristles taking on a rounded shape. The toothbrush is further provided with a novel calendar reminder mechanism in the form of a rotatable cap coupled to the distal end of the brush handle, allowing a user to set a month reminder for the next time the detachable bristle head should be replaced.

Thus, according to one aspect of the present disclosure there is provided a toothbrush, the toothbrush comprising: a handle portion; a bristle frame disposed at a first end of the handle portion and configured for receiving a detachable bristle head, the bristle frame providing a partially raised mounting surface for the bristle head with respect to the handle portion and having a locking mechanism for coupling to the bristle head disposed on the mounting surface, the locking mechanism comprising a ridged portion with at least four semi-circular notches protruding inward therefrom.

The toothbrush further comprising a detachable bristle head, the detachable bristle head having a first planar surface comprising a plurality of parallel rows of bristle mounting holes forming horizontal broken lines, the opposite side of the bristle head comprising an indent with at least four semi-circular openings corresponding to the at least four semi-circular notches of the bristle frame locking mechanism, the indent being configured to interface with the ridged portion of the bristle frame such that the entire raised mounting surface of the bristle frame is encapsulated by the bristle head to form a watertight seal; and a cap rotatably coupled to a second end of the handle portion, the cap and the second end of the handle portion comprising calendar markings such that a user may set a reminder month indicating when the detachable bristle head must be replaced.

In some embodiments, the bristles of the bristle head are formed into a soft rounded shape to prevent gum bleeding.

In some embodiments, the detachable bristle head further comprises a pair of tabs having raised gripping ridges, the tabs being configured to interlock with a pair of indents on either side of the bristle frame to facilitate easy removal of the bristle head by a user when desired. Each of the tabs may comprise a locking portion that interlocks with the bristle frame indents.

In some embodiments, the bristle head further comprises four external locking tabs that interlock with the external side surfaces of the bristle frame.

In some embodiments, the handle portion is provided with one or more grip indents.

In some embodiments, the bristles are made from nylon.

In some embodiments, the handle is formed of stainless steel.

In some embodiments, the bristle frame is formed of plastic.

In some embodiments, the calendar markings on the cap consist of four notches distributed about the circumference of the cap, each notch being labelled with one respectively of the markings: 1, 2, 3, change, such that each month the user can count down another month to the date the bristle head must be replaced.

In some embodiments, the reminder markings are colour coded.

In some embodiments, the cap is rotatable throughout a full 360 degrees with respect to the handle portion.

In some embodiments, the cap is affixed to the handle portion by a ring of inner locking tabs of the cap interlocking with an outer ring of locking tabs on the handle portion.

BRIEF DESCRIPTION OF THE DRAWINGS

Various embodiments of the invention are disclosed in the following detailed description and accompanying drawings.

Figure 1:
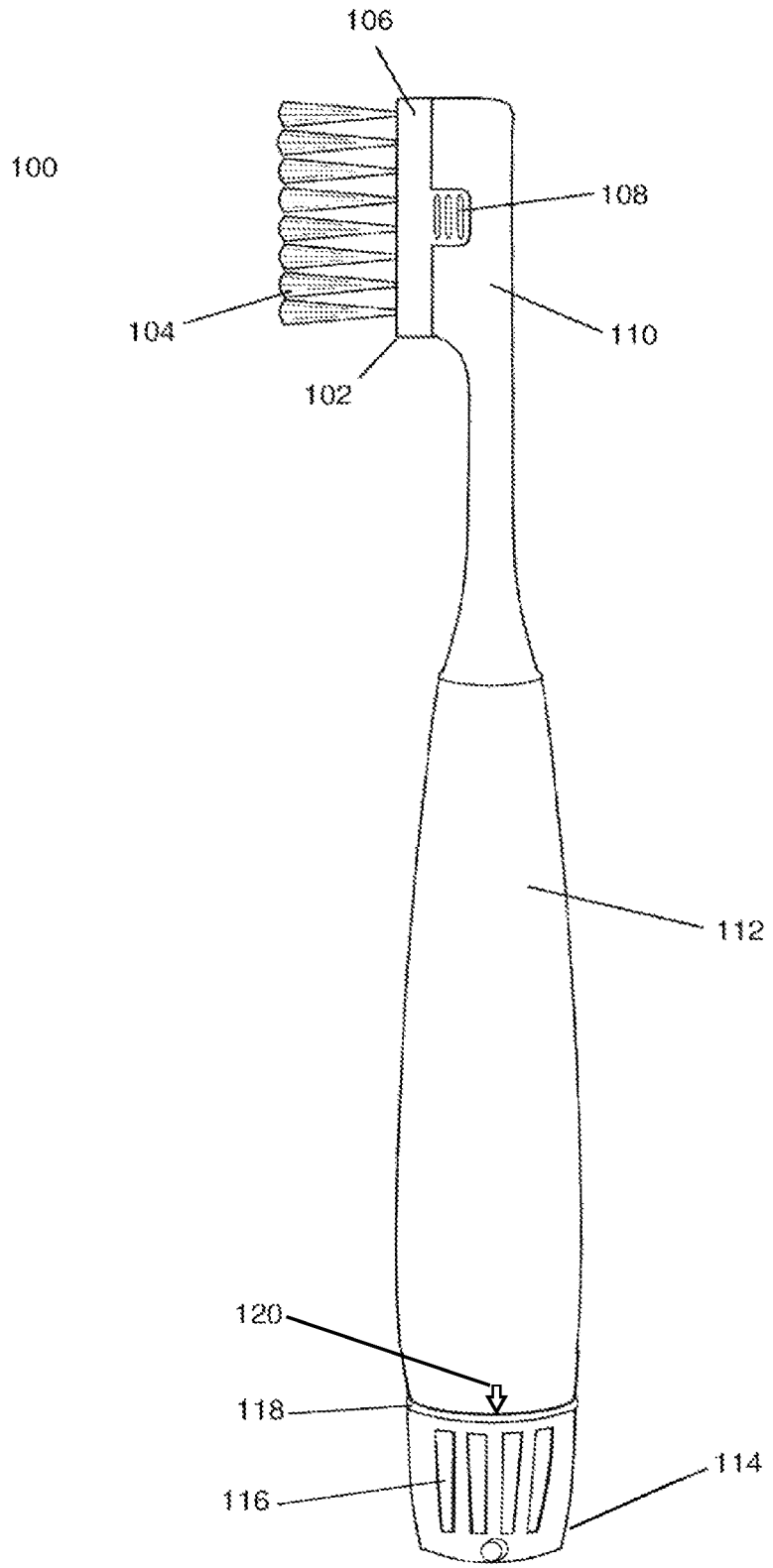
FIG. 1 illustrates a first isometric view of an example toothbrush and detachable bristle head configuration according the present disclosure.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The present disclosure provides a toothbrush with a detachable bristle head having bristles arranged in a rounded trim to facilitate deep cleaning between the teeth and gum line and effective removal of plaque and debris without making a user's gums bleed. The bristles are also arranged in clusters forming broken parallel lines horizontally across the front surface, rather than vertical rows of rounded clusters as with traditional toothbrush bristles, this prevents the bristles from deforming horizontally in use.

Additionally, the toothbrush of the present disclosure is provided with a calendar reminder mechanism in the form of a rotatable cap with markings, allowing a user to set a date on the toothbrush for the next time they need to replace the detachable bristle head so that they are reminded each time they brush their teeth.

Example configurations of the disclosed toothbrush and detachable bristle head will now be described in detail, however it should be recognised that the principles described above may be applied to a wide variety of different specific tooth brush designs and configurations.

Figure 2:
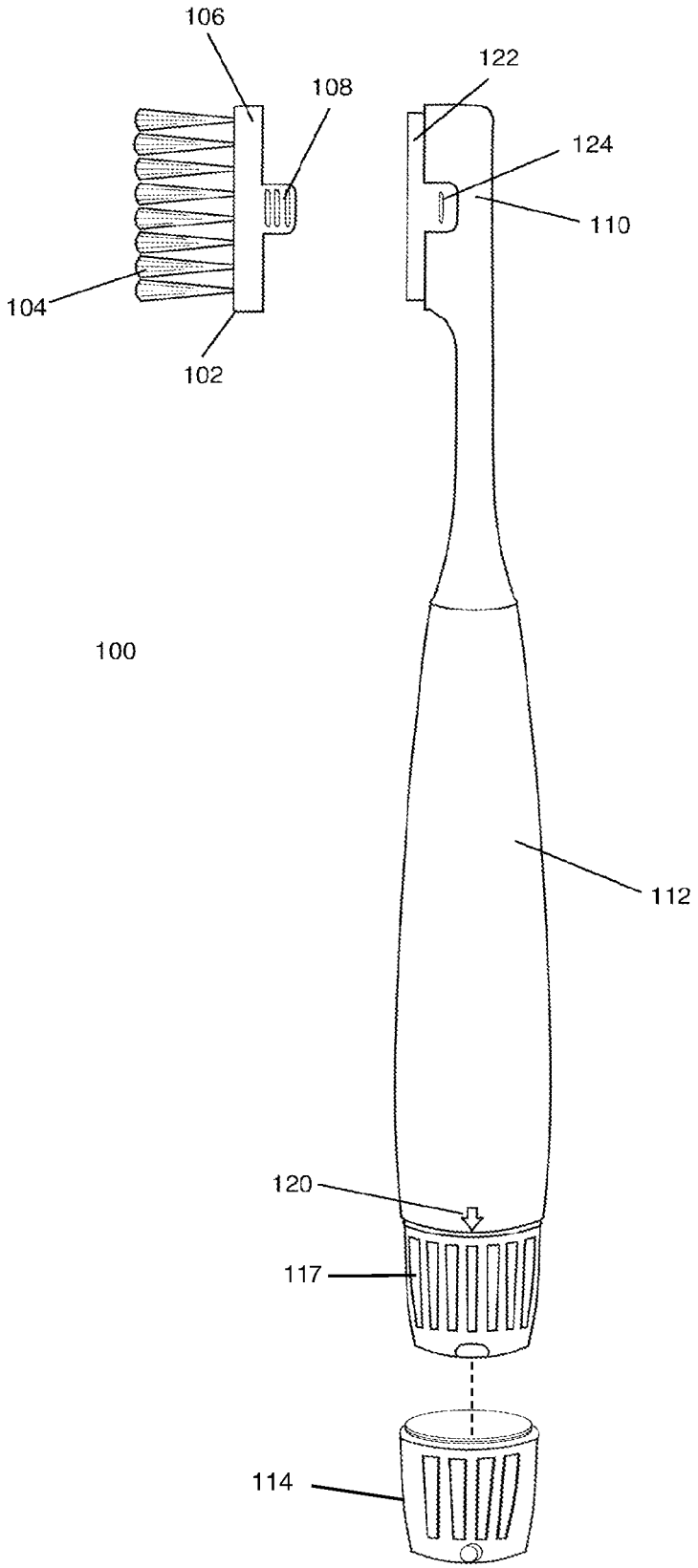
FIG.2 illustrates a second isometric view of the example toothbrush and detachable bristle head configuration according the present disclosure with the bristle head and rotatable calendar cap removed.

Thus, referring to FIG. 1 and FIG. 2, a first isometric view of an example toothbrush 100 and detachable bristle head 102 is shown. FIG. 1 shows the bristle head 102 attached to the toothbrush and FIG. 2 shows it removed from it.

The detachable bristle head 102 comprises a number of horizontal rows of bristles 104 arranged in broken horizontal lines across a first surface of a base portion 106. The base portion 106 is shaped so as to completely encompass and form a watertight seal with a raised bristle frame 110 of the toothbrush 100, and has two grip tabs 108 which extend either side of the bristle frame 110. The bristle head 102 may be made of plastic and the bristles 104 themselves may be made of nylon.

The bristle frame 110 of the toothbrush is connected to a handle portion 112, the opposing end of which is fitted with a cap 114 that is rotatable coupled to the handle 112 by a ring portion. The coupling between the cap 114 and the handle 112 also comprises a plurality of locking notches which cause the cap 114 to rotate by set amounts each time it is turned with respect to the handle 112. A marking 120 is placed on a portion of the handle 112 adjacent to the cap 114 and reminder markings are placed on the cap, for example on the bottom surface, so that turning the cap 114 with respect to the handle 112 causes different reminder markings to be aligned with the marker 120, allowing a user to easily set a visual reminder for the next time the detachable head 102 needs to be exchanged, which they will see each time they use the toothbrush.

Figure 6:
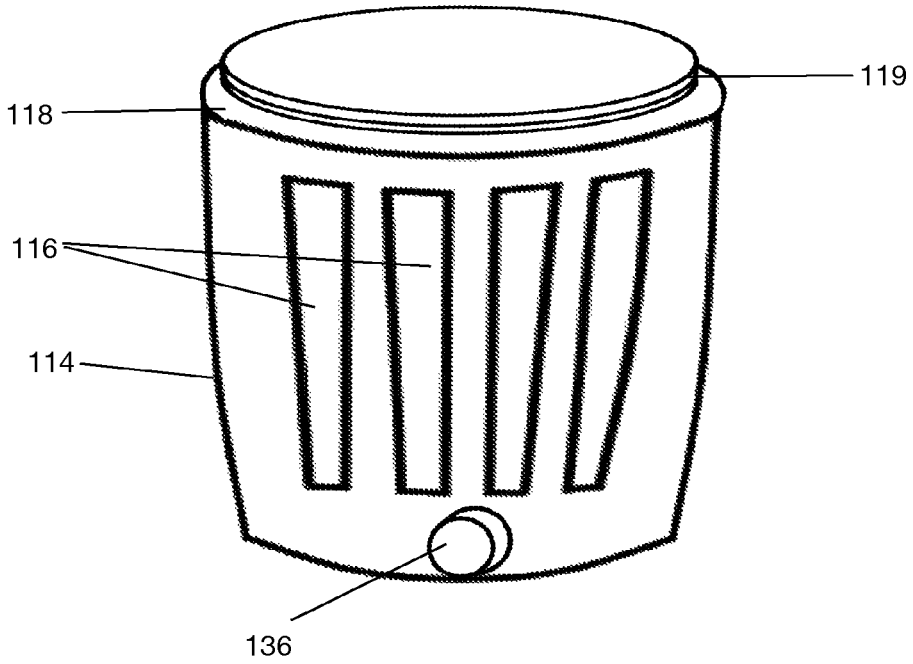
FIG. 6 illustrates a close-up view of the rotatable calendar cap removed from the body of the toothbrush.

Various types of date reminder systems can be used, including a standard calendar type reminder, or a novel reminder system which is disclosed in further detail with reference to FIG. 6.

As can be seen in FIG. 2 where the detachable bristle head 102 has been removed, the bristle frame 110 comprises a raised mounting point 122 having an edge that fits within a cavity on the rear surface of the bristle head 102, and also comprises one or more locking indents 124 and 125 for interlocking with the tabs 108 of the bristle head. The raised shape of the bristle frame 110 facilitates placing such locking mechanisms on all four sides. The bristle head 102 may have up to four locking tabs that interlock with similar indents on each edge of the bristle head/bristle frame.

Figure 3:
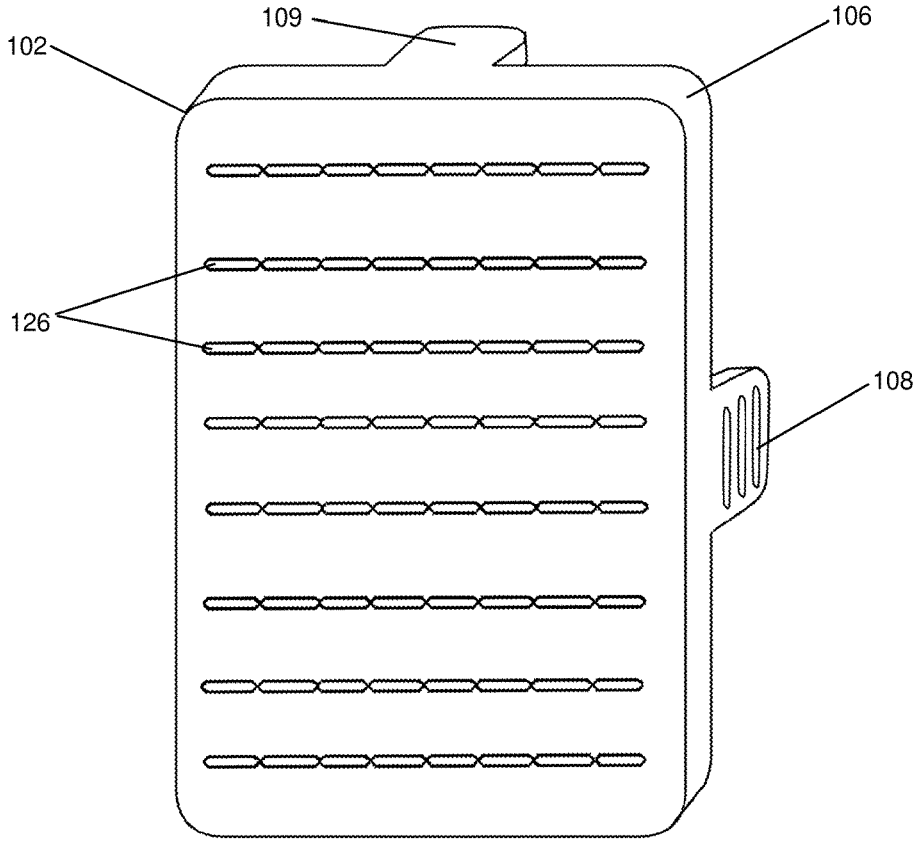
FIG. 3 illustrates an isometric view of the front side of an example detachable bristle head according the present disclosure.
Figure 4:
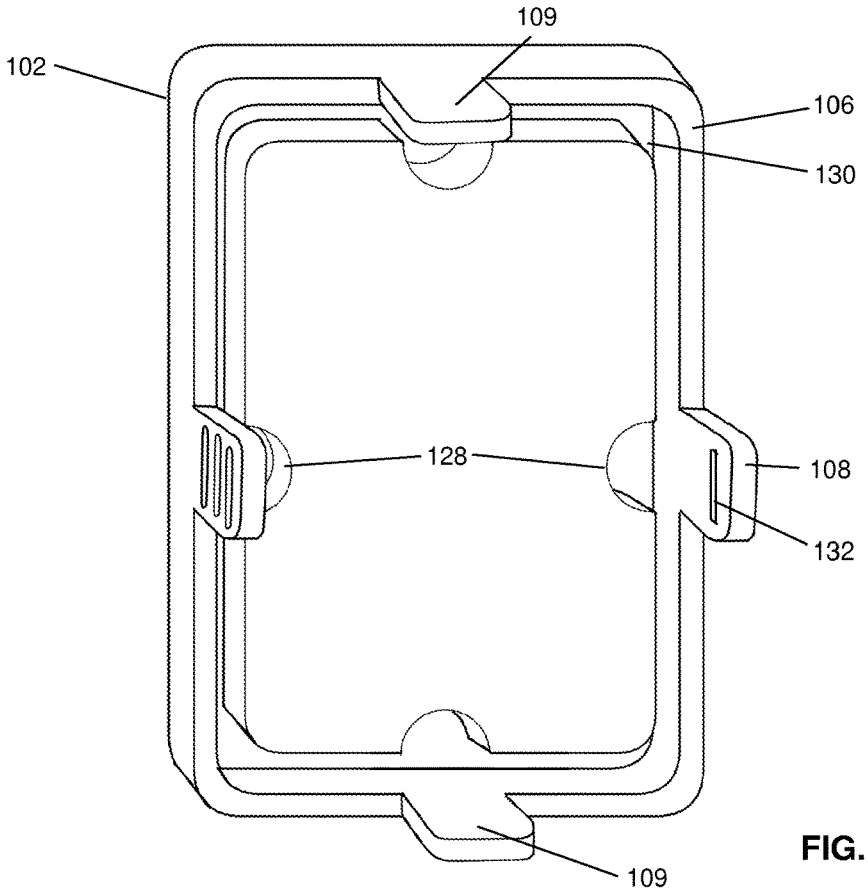
FIG. 4 illustrates an isometric view of the back side of an example detachable bristle head according the present disclosure.

Referring to FIG. 3 and FIG. 4, front and rear views of the bristle head 102 are shown close up to better illustrate an example configuration that would allow for effective locking and formation of a watertight seal between the head 102 and the frame 110.

The front view shown in FIG. 3 is illustrated with the bristles 104 removed, so that the mounting points 126 of the bristle head 102 and their broken horizontal line formation can be shown more clearly. The arrangement conveys greater lateral resistance to deformation of the bristles.

The rear view of FIG. 4 shows an example shape of a rear surface of the bristle head base 106 that would allow for effective interlocking with a bristle frame 110. As can be seen, the outer edge of the rear surface of the base 106 forms a lip 130 which would completely encase the raised ridge of the toothbrush bristle frame 110. This is accompanied by an inner structure with four semi-circular indents 128 which would "click" into place with corresponding semi-circular notches on the bristle frame 110.

This structure, in combination with the four locking/grip tabs 108 and 109 and their locking portions 132 allows for a complete seal to be formed between the two parts on all four sides fo the structure, but also for a user to grip and lift away the bristle head 102 from the brush bristle frame 110.

While the bristle head is illustrated in a rounded rectangle shape, it will be recognised that various bristle head shapes may be used, including, for example, a bristle head with flat sides but rounded oval-shaped top and bottom edges.

Figure 5:
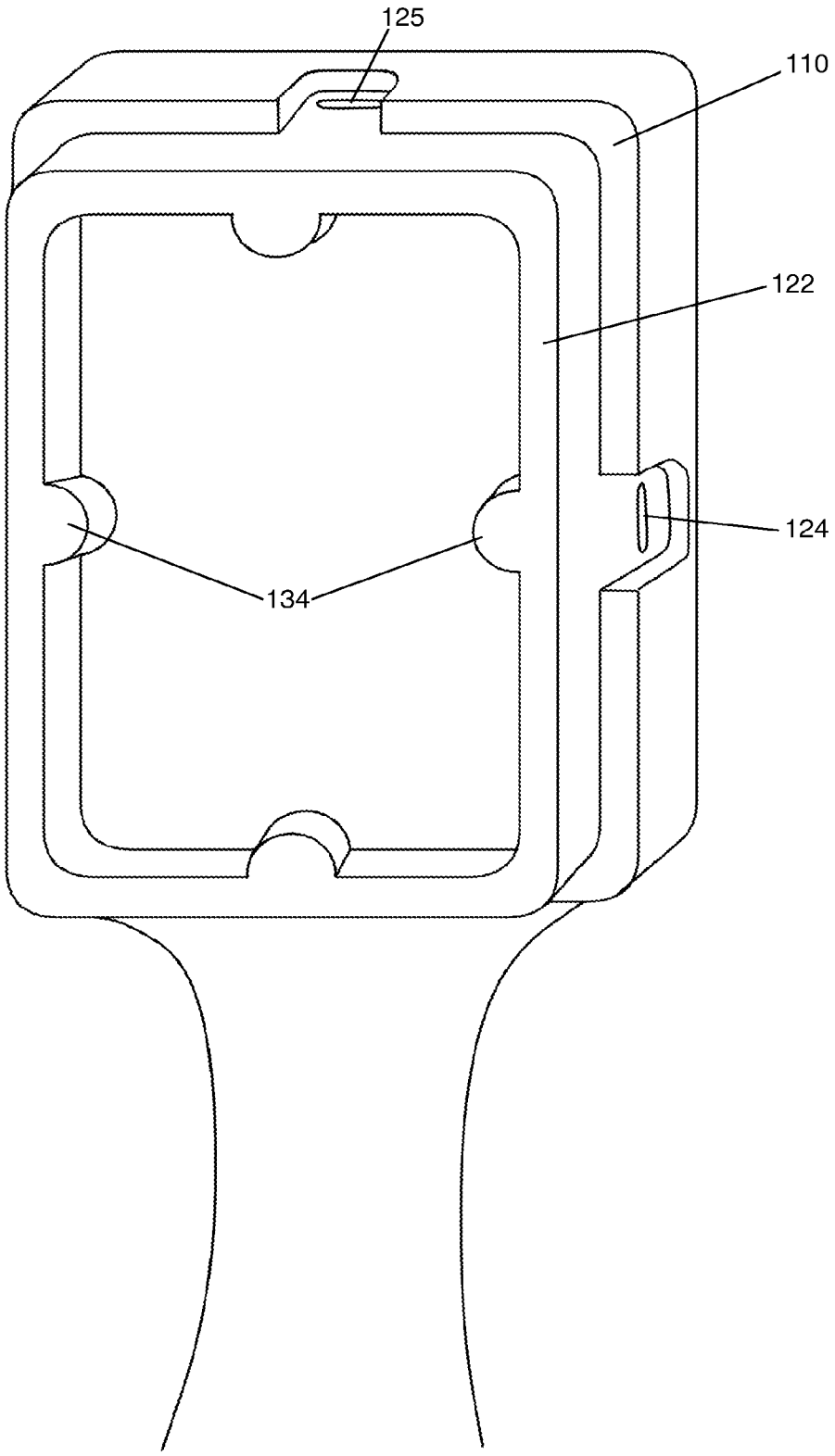
FIG. 5 illustrates a close-up view of an example bristle frame configuration of a toothbrush according to the present disclosure with the detachable bristle head removed.

Referring to FIG. 5, a corresponding structure of the bristle frame 110 for interlocking with the rear structure of the bristle head 102 shown in FIG. 4 is illustrated in greater detail. Specifically, the bristle frame 110 of the present example has a raised ridge 122 with four corresponding semi-circular notches 134 that interlock and click into place with the semi-circular indents of the bristle head.

In some examples while the bristle base may be comprised of plastic and the bristles comprised of nylon since they are meant to be replaced, the handle portion of the toothbrush itself is made of stainless steel and is thus reusable. This reduces plastic pollution and use, for which toothbrushes are notoriously responsible for, by 98%.

Referring to FIG. 6, a close-up view of an example configuration of the rotatable calendar cap 114 is shown removed from the body of the toothbrush.

As can be seen, the calendar cap 114 has a coupling portion 118 that allows it to attach to the bottom of the toothbrush handle in such a way that it is non-removable. This coupling consists of an indented ring 119 that would interlock with a cooperating ring within the toothbrush handle, the internal ring 119 would sit within the toothbrush handle ring and allow for rotational movement but the ridged shape of the ring would prevent removal of the cap. This is merely one example mechanism for coupling the cap and toothbrush body however.

The cap 114 rotational mechanism may also incorporate a knob 136 that only allows rotation of the cap 114 with respect to the toothbrush body when pressed.

The angles at which the cap 114 may rotate with respect to the toothbrush body may be fixed, for example with a ring of inner locking tabs 117 on the cap interlocking with an outer ring of locking tabs 116 on the handle portion, as shown in FIG. 2, only allowing rotation angles where a marking 120 on the toothbrush body is in alignment with one of the plurality of locking tabs 116. This allows reminders to easily be set with the calendar cap, either through a standard calendar reminder or via a novel reminder system as described below.

That is, in some examples, each locking tab may have an associated marking next to it labelling the locking tabs with one of the markings: 1, 2, 3, change. Each number represents a month of time, and this novel system acts as a 3 month countdown, whereby the user would set the cap at "3" or "1" as soon as a new bristle head replaces an old one, and then count the number down/up each month until it is time to "change" the bristle head. This system keeps a user actively thinking about when the bristle head will next be replaced and reduces the likelihood of them forgetting.

The reminder markings may be colour coded. In general the cap 114 is rotatable throughout a full 360 degrees with respect to the handle portion.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the toothbrush with detachable bristle head have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A toothbrush, the toothbrush comprising:

a handle portion;

a bristle frame disposed at a first end of the handle portion and configured for receiving a detachable bristle head, the bristle frame providing a partially raised mounting surface for the bristle head with respect to the handle portion and having a locking mechanism for coupling to the bristle head disposed on the raised portion of the mounting surface, the locking mechanism comprising a ridged portion with at least four semi-circular notches protruding inward therefrom;

a detachable bristle head, the detachable bristle head having a first planar surface comprising a plurality of parallel rows of bristle mounting holes forming horizontal broken lines, a second surface opposite to the first planar surface of the bristle head comprising an indent with at least four semi-circular openings corresponding to the at least four semi-circular notches of the bristle frame locking mechanism, the indent being configured to interface with the ridged portion of the bristle frame such that the entire raised mounting surface of the bristle frame is encapsulated by the bristle head to form a watertight seal; and a cap rotatably coupled to a second end of the handle portion, the cap and the second end of the handle portion comprising calendar markings such that a user may set a reminder month indicating when the detachable bristle head must be replaced.

2. A toothbrush according to claim 1, wherein the bristles of the bristle head are formed into a soft rounded shape to prevent gum bleeding.

3. A toothbrush according to claim 1, wherein the detachable bristle head further comprises a pair of tabs having raised gripping ridges, the tabs being configured to interlock with a pair of indents on either side of the bristle frame to facilitate easy removal of the bristle head by a user when desired.

4. A toothbrush according to claim 3, wherein each of the tabs comprises a locking portion that interlocks with the bristle frame indents.

5. A toothbrush according to claim 1, wherein the bristle head further comprises four external locking tabs that interlock with the external side surfaces of the bristle frame.

6. A toothbrush according to claim 1, wherein the handle portion is provided with one or more grip indents.

7. A toothbrush according to claim 1, wherein the bristles are made from nylon.

8. A toothbrush according to claim 1, wherein the handle is formed of stainless steel.

9. A toothbrush according to claim 1, wherein the bristle frame is formed of plastic.

10. A toothbrush according to claim 1, wherein the calendar markings on the cap consist of four notches distributed about the circumference of the cap, each notch being labelled with one respectively of the markings: 1, 2, 3, change, such that each month the user can count down another month to the date the bristle head must be replaced.

11. A toothbrush according to claim 1, wherein the reminder calendar markings are colour coded.

12. A toothbrush according to claim 1, wherein the cap is rotatable throughout a full 360 degrees with respect to the handle portion.

13. A toothbrush according to claim 1, wherein the cap is affixed to the handle portion by a ring portion of the cap interlocking with a second ring on the handle portion, whereby rotational movement of the cap relative to the handle is allowed.

14. The toothbrush according to claim 13, wherein the cap is further affixed to the handle portion by a plurality of inner locking tabs within the cap interlocking with a plurality of outer locking tabs on the handle portion, whereby only fixed rotation angles, where a marking on the toothbrush body is in alignment with one of the plurality of locking tabs, are allowed.

* * * * *